US007331757B2

(12) United States Patent
Janssen et al.

(10) Patent No.: US 7,331,757 B2
(45) Date of Patent: Feb. 19, 2008

(54) TURBINE SHAFT AND PRODUCTION OF A TURBINE SHAFT

(75) Inventors: Wolfgang Janssen, Heiligenhaus (DE); Torsten-Ulf Kern, Wesel (DE); Heinz Klöckner, Mülheim (DE)

(73) Assignee: Siemens Aktiengesellschaft, Munich (DE)

( * ) Notice: Subject to any disclaimer, the term of this patent is extended or adjusted under 35 U.S.C. 154(b) by 142 days.

(21) Appl. No.: 10/537,237

(22) PCT Filed: Dec. 2, 2003

(86) PCT No.: PCT/DE03/03959

§ 371 (c)(1),
(2), (4) Date: May 31, 2005

(87) PCT Pub. No.: WO2004/051056

PCT Pub. Date: Jun. 17, 2004

(65) Prior Publication Data

US 2006/0153686 A1 Jul. 13, 2006

(30) Foreign Application Priority Data

Dec. 5, 2002 (DE) ..... 102 57 091

(51) Int. Cl.
*F01D 25/00* (2006.01)

(52) U.S. Cl. ..... 415/200; 415/216.1; 29/889.2

(58) Field of Classification Search ..... 415/200, 415/216.1; 29/889.2
See application file for complete search history.

(56) References Cited

U.S. PATENT DOCUMENTS 4,962,586 A 10/1990 Clark et al.
5,407,797 A 4/1995 Marliere et al.
5,487,082 A * 1/1996 Takenouchi et al. ..... 373/42
5,814,274 A * 9/1998 Komai et al. ..... 420/106
6,152,697 A 11/2000 Konishi et al.
6,454,531 B1 9/2002 Crawmer
6,499,946 B1 * 12/2002 Yamada et al. ..... 415/199.4

FOREIGN PATENT DOCUMENTS

DE 29 06 371 A1 8/1980
DE 694 21 198 T2 8/1994
DE 199 53 079 A1 5/2001
EP 0 964 135 A2 12/1999

OTHER PUBLICATIONS

B. Huchtemann, K. Forch, E. Potthast, H. Weber and W. Witte, "Fortschritte bei warmfesten und hochwarmfesten Stählen", Stahl U. Eisen, vol. 106, No. 13, Jun. 30, 1986, pp. 733-738, XP008030416.

* cited by examiner

*Primary Examiner*—Ninh H. Nguyen

(57) ABSTRACT

The invention relates to a turbine shaft for a steam turbine, oriented in an axial direction and comprising a first and a second flow region. According to the invention, a first material is provided in the first flow region of the turbine shaft, and a second flow region is provided in the second flow region thereof, the first material having heat-resistant properties and the second material having cold-resistant properties. The inventive turbine shaft is produced by means of a construction weld seam without any previous buffer layer welding on one of the two materials.

12 Claims, 1 Drawing Sheet

TURBINE SHAFT AND PRODUCTION OF A TURBINE SHAFT

CROSS REFERENCE TO RELATED APPLICATION

This application is the US National Stage of International Application No. PCT/DE2003/003959, filed Dec. 2, 2003 and claims the benefit thereof. The International Application claims the benefits of German Patent applications No. 10257091.4 DE filed Dec. 5, 2002, all of the applications are incorporated by reference herein in their entirety.

FIELD OF THE INVENTION

The invention relates to a turbine shaft, which is oriented in an axial direction, for a steam turbine, having a first flow region and a second flow region, which adjoins the first flow region in the axial direction, the turbine shaft comprising a first material in the first flow region and comprising a second material in the second flow region. The invention also relates to a process for producing a turbine shaft which comprises two materials and is oriented in an axial direction.

BACKGROUND OF THE INVENTION

Turbine shafts are generally used in turbomachines. A steam turbine may be considered as an example of a turbomachine. To increase efficiency, steam turbines are designed as what are known as combined steam turbines. Steam turbines of this type have an inflow region and two or more flow regions designed with rotor blades and guide vanes. A flow medium flows via the inflow region to a first flow region and then to a further flow region. Steam may be considered as an example of a flow medium in this context.

By way of example, steam is passed into the inflow region at temperatures of over 400° C. and from there passes to the first flow region. In this case, various components, in particular the turbine shaft, are subject to thermal loads in the first flow region. Downstream of the first flow region, the steam flows to the second flow region. The steam is generally at lower temperatures and pressures in the second flow region. The turbine shaft should have properties of being tough at low temperatures in this region.

Various solutions have hitherto been disclosed for combining the two required properties of the turbine shaft with one another. One solution provides for the heat-resistant property and the property of being tough at low temperatures to be combined with one another in the turbine shaft. In this case, what is described as a monobloc shaft which combines the two required properties with certain restrictions is used. However, this involves compromises which can lead to restrictions on the design and operation of the steam turbine.

It is also known to weld turbine shafts. In the case of the materials which have been disclosed hitherto, with the associated demands imposed thereon, a buffer weld has to be applied to a material, which has to be annealed at a set temperature. After the annealing of the buffer weld on a first material, the two parts of the turbine shaft made from a first material and a second material are joined by a structural weld with a final tempering treatment at a temperature which is lower than the temperature used during the annealing of the buffer weld. Hitherto, 1% CrMoV has been used as material for the first region of the turbine shaft, which needs to have heat-resistant properties. Hitherto, 3.5% NiCrMoV has been used for the second region of the turbine shaft, which has to be tough at low temperatures.

The process for producing turbine shafts of this type is expensive and complicated.

SUMMARY OF THE INVENTION

It is an object of the present invention to provide a turbine shaft which has cold toughness and heat resistance properties. A further object of the invention is to provide a process for producing the turbine shaft.

The object relating to the turbine shaft is achieved by the characterizing features of the claims.

Advantageous configurations are presented in the dependent claims.

The object relating to the process is achieved by the characterizing features of the claims.

The invention is based on the discovery that it is possible to dispense with the need for an additional buffer weld and an additional intermediate anneal by suitable selection of materials and a correspondingly modified heat treatment.

One advantage is that a turbine shaft can be produced more quickly and therefore at reduced cost.

BRIEF DESCRIPTION OF THE DRAWINGS

Exemplary embodiments of the invention are explained in more detail below with reference to drawings. Corresponding parts are provided with the same reference numerals throughout all the figures. In the drawing, diagrammatically and not to scale.

DETAILED DESCRIPTION OF THE INVENTION

The greatly simplified FIGS. 1, 2, 3 and 4 illustrate only those parts which are of importance to gaining an understanding of the functioning of the invention.

In a combined medium-pressure and low-pressure steam turbine (not shown), live steam flows along a first section of a turbine shaft, where it is expanded and cooled at the same time. Therefore, the material of the turbine shaft is required to have heat-resistant properties in this first subsection. The temperature of the live steam may be up to 565° C. The cooled and expanded live steam flows into a second subsection, in which the turbine shaft is required to be tough at low temperatures.

Figure 1:
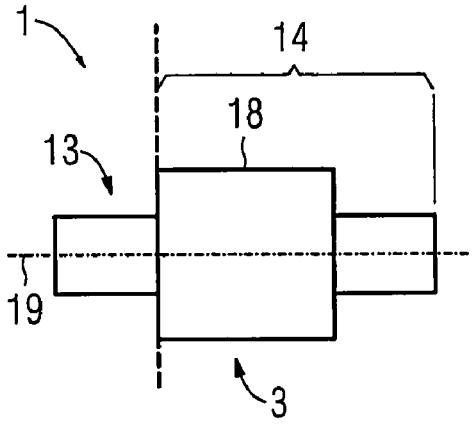
FIG. 1 shows a sectional illustration through a single-material turbine shaft which forms part of the prior art.

The turbine shaft 1 illustrated in FIG. 1 is known as a monobloc shaft and includes the material 23 CrMoNiWV 8-8, and is oriented in an axial direction 19. This turbine shaft 1 forms part of the prior art.

This turbine shaft 1 is usually used for combined steam turbines with an outflow surface area of between 10 and 12.5 $m^2$ in a reverse flow mode at 50 Hz. In the reverse flow mode, a direction of flow is substantially reversed after the medium has flowed through the medium-pressure part 13, so that the medium then flows through the low-pressure part 14. The material 23 CrMoNiWV 8-8 comprises 0.20-0.24% by weight of C, ≦0.20% by weight of Si, 0.60-0.80% by weight of Mn, ≦0.010% by weight of P, ≦0.007% by weight of S, 2.05-2.20% by weight of Cr, 0.80-0.90% by weight of Mo, 0.70-0.80% by weight of Ni, 0.25-0.35% by weight of V and 0.60-0.70% by weight of W. The required properties with regard to heat resistance and toughness at low temperatures have hitherto, with certain restrictions, been combined by the use of the turbine shaft 1 described in FIG. 1. This turbine shaft 1, with the described material 23 CrMoNiWV 8-8, reaches strength and toughness limits in the low-pressure part 14 at large diameters if demands for a static strength of over $R_p$ 0.2>650 MPa are imposed for an edge region 18.

Figure 2:
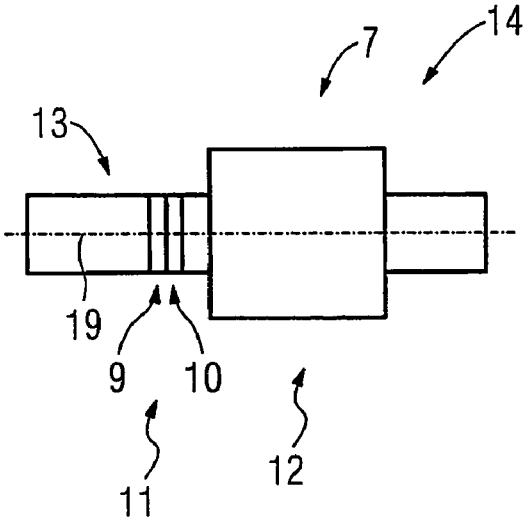
FIG. 2 shows a sectional illustration through a turbine shaft consisting of two materials but forming part of the prior art.

The turbine shaft 7 illustrated in FIG. 2 forms part of the prior art and has a medium-pressure part 13, which is exposed to high temperatures. The turbine shaft 7 likewise has a low-temperature part 14, which is subject to lower thermal loads than the medium-pressure part 13 and is oriented in an axial direction. On the other hand, the low-pressure part 14 is subject to higher mechanical loads than the medium-pressure part 13. The medium-pressure part 13 and the low-pressure part 14 generally consist of different materials. The medium-pressure part 13 consists of 1% CrMoV (30 CrMoNiV 5-11), and the low-pressure part consists of the material 3.5 NiCrMoV (26 NiCrMoV 14-5). The material 30 CrMoNiV 5-11 comprises 0.27-0.34% by weight of C, ≦0.15% by weight of Si, 0.30-0.80% by weight of Mn, ≦0.010% by weight of P, ≦0.007% by weight of S, 1.10-1.40% by weight of Cr, 1.0-1.20% by weight of Mo, 0.50-0.75% by weight of Ni and 0.25-0.35% by weight of V. The first material substantially comprises a heat-resistant material, and the second material substantially comprises a material which is tough at low temperatures.

The medium-pressure part 13 has to have heat-resistant properties, and the low-pressure part 14 has to have cold toughness properties. The turbine shaft 7 includes a buffer weld 9, which is first of all applied to the medium-pressure part 13 and annealed at a temperature T1. Then, the medium-pressure part 13 and the low-pressure part 14 are joined to one another by a weld seam. This welding operation is followed by annealing at a temperature T2. The reason for the different temperatures T1 and T2 is the different chemical composition and microstructural formation of the materials and the resulting different tempering stability: T1>T2. High hardnesses in the heat-affected zones and internal stresses need to be avoided by using tempering temperatures which are as high as possible without having an adverse effect on the strength of the individual shafts, which have already been produced and tested.

Figure 3:
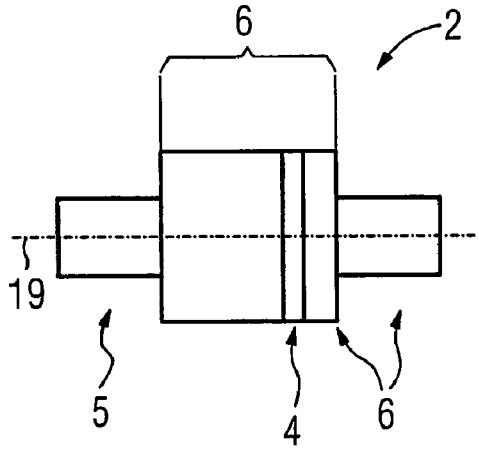
FIG. 3 shows a sectional illustration through a turbine shaft.

FIG. 3 shows a turbine shaft 2 according to the invention in a reverse flow design. The turbine shaft 2 has a medium-pressure section 5, formed as first flow region 5, and a low-pressure section 6, formed as second flow region. The low-pressure section 6 is joined to the medium-pressure section 5 by means of a structural weld 4. The welding of the medium-pressure part 5 and the low-pressure part 6, which comprise two different materials, is carried out without an additional buffer weld and therefore also without an additional intermediate anneal of the latter. The medium-pressure part 5, as far as the penultimate low-pressure stage, comprises the material 2 CrMoNiWV (23 CrMoNiWV 8-8), and the low-pressure part comprising the final low-pressure stage consists of the material 3.5 NiCrMoV (26 NiCrMoV 14-5). The material 23 CrMoNiWV 8-8 comprises 0.20-0.25% by weight of C, ≦0.20% by weight of Si, 0.60-0.80% by weight of Mn, ≦0.010% by weight of P, ≦0.007% by weight of S, 2.05-2.20% by weight of Cr, 0.80-0.90% by weight of Mo, 0.70-0.80% by weight of Ni, 0.25-0.35% by weight of V and 0.60-0.70% by weight of W, and the material 26 NiCrMoV 14-5 comprises 0.22-0.32% by weight of C, ≦0.15% by weight of Si, 0.15-0.40% by weight of Mn, ≦0.010% by weight of P, ≦0.007% by weight of S, 1.20-1.80% by weight of Cr, 0.25-0.45% by weight of Mo, 3.40-4.00% by weight of Ni, 0.05-0.15% by weight of V.

The weld is designed in the form of a structural weld, with a weld filler being supplied during the structural welding. The weld filler should comprise, for example, 2% of nickel.

After the welding, the welded shaft should be tempered for a sufficient length of time, between 2 and 20 hours, at a temperature of between 600° C. and 640° C.

The particular advantage of the 3.5 NiCrMoV material is that it has a static strength of up to $R_p$ 0.2>760 MPa without any toughness problems. Tempering at the abovementioned temperatures has scarcely any effect on the strength of the weld seam. The internal stresses and the hardness in the heat-affected zone are reduced, so that the risk of stress corrosion cracking caused by moist media can be avoided. The Vickers hardness is HV≦360. The result is a welded shaft which has the required heat resistance in the front part but can withstand the high demands imposed on strength and toughness by the high blade centrifugal forces in the rear part. The join only has to be welded once and annealed once.

Figure 4:
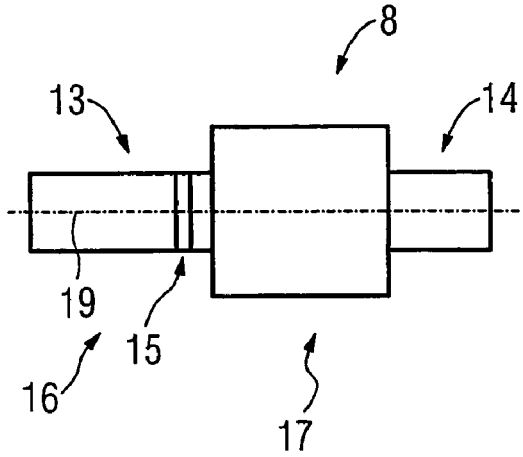
FIG. 4 shows a sectional illustration through a turbine shaft.

The turbine shaft 8 illustrated in FIG. 4 shows a turbine shaft 8 oriented in the axial direction 19 for use in straight-flow mode. The turbine shaft 8 has a medium-pressure part 13, formed as first flow region (13), and a low-pressure part 14, formed as second flow region (14). The medium-pressure part 13 and the low-pressure part 14 are joined via a structural weld seam 15. The advantage of this embodiment for the straight flow mode compared to the embodiment illustrated in FIG. 2 consists in particular in the fact that the replacement of the 1 CrMoV steel, which is more stable with respect to tempering, by the 2 CrMoNiWV steel with similar heat resistances but a lower stability during tempering, on account of the tempering parameters selected, allows the hardnesses in the heat-affected zones of the 2 CrMoNiWV and 3.5 NiCrMoV and the internal stresses to be reduced to the necessary levels. The result in this case too is a welded turbine shaft 8, which has the required heat resistance in the medium-pressure part 13 and satisfies the high demands on strength and toughness which are imposed on the low-pressure part 14.

Further advantages result from the fact that the turbine shaft only has to be welded once and tempered once. This reduces the production cycle times. It is possible to realize further design solutions with high demands on strength and toughness in the low-pressure part 14 and a high heat resistance in the medium-pressure part 13 for new steam turbine assemblies.

The invention claimed is:

1. A turbine shaft oriented in an axial direction, comprising:

a first flow region;

a second flow region that adjoins the first flow region in an axial direction;

a first material in the first flow region; and a second material in the second flow region, the second material joined to the first material through at least one weld joint, wherein the first material comprises a heat-resistant steel having undergone a tempering process and the second material comprises a steel which is tough at low temperatures and wherein the first material is characterized by a low stability during the tempering process relative to 1 CrMoV steel, wherein:

the first material includes 0.20-0.24% by weight of C, ≦0.20% by weight of Si, 0.60-0.80% by weight of Mn, ≦0.010% by weight of P, ≦0.007% by weight of S, 2.05-2.20% by weight of Cr, 0.80-0.90% by weight of Mo, 0.70-0.80% by weight of Ni, 0.25-0.35% by weight of V and 0.60-0.70% by weight of W, and the second material includes 0.22-0.32% by weight of C, ≦0.15% by weight of Si, 0.15 to 0.40% by weight of Mn, ≦0.010% by weight of P, ≦0.007% by weight of S, 1.20-1.80% by weight of Cr, 0.25-0.45% by weight of Mo, 3.40-4.00% by weight of Ni, 0.05-0.15% by weight of V.

2. The turbine shaft as claimed in claim 1, wherein the first material comprises a 2 CrMoNiWV steel and the second material comprises a 3.5 NiCrMoV steel.

3. The turbine shall as claimed in claim 1, wherein a single structural weld seam is arranged between the first material and the second material.

4. The turbine shaft as claimed in claim 1, wherein the tempering process is characterized by a temperature between 600 C and 640 C thereby allowing characteristic hardness in a heat-affected zone of the first material to be reduced.

5. The turbine shaft as claimed in claim 1, wherein the tempering process is characterized by a temperature between 600 C and 640 C thereby allowing internal stress in a heat-affected zone of the first material to be reduced.

6. A process for producing a turbine shaft, comprising:

orienting a first material and a second material in an axial direction; and directly joining the first and second materials to one another by a single structural weld;

tempering the welded first and second materials, wherein the first material comprises a heat-resistant steel having undergone a tempering process and the first material is characterized by a low stability during the tempering process relative to 1 CrMoV steel.

7. The process as claimed in claim 6, wherein a 2 CrMoNiWV steel is used for the first material and a 3.5 NiCrMoV steel is used for the second material.

8. The process as claimed in claim 6, wherein 0.20-0.24% by weight of C, ≦0.20% by weight of Si, 0.60-0.80% by weight of Mn, ≦0.010% by weight of P, ≦0.007% by weight of S, 2.05-2.20% by weight of Cr, 0.80-0.90% by weight of Mo, 0.70-0.80% by weight of Ni, 0.25-0.35% by weight of V and 0.60-0.70% by weight of W is used for the first material, and 0.22-0.32% by weight of C, ≦0.15% by weight of Si, 0.15-0.40% by weight of Mn, ≦0.010% by weight of P, ≦0.007% by weight of S, 1.20-1.80% by weight of Cr, 0.25-0.45% by weight of Mo, 3.40-4.00% by weight of Ni, 0.05-0.15% by weight of V is used for the second material.

9. The process as claimed in claim 6, wherein the tempering process is performed at a temperature between 600 C and 640 C thereby allowing characteristic hardness in a heat-affected zone of the first material to be reduced.

10. The process as claimed in claim 9, wherein the tempering process reduces characteristic hardness in a heat-affected zone of the first material to produce a rotor for use in a steam turbine.

11. A turbine shaft oriented in an axial direction, comprising:

a first flow region;

a second flow region that adjoins the first flow region in an axial direction;

a first material in the first flow region; and a second material in the second flow region, wherein the first material comprises a heat-resistant steel having the composition:

0.20-0.24% by weight of C, ≦0.20% by weight of Si, 0.60-0.80% by weight of Mn, ≦0.010% by weight of P, ≦0.007% by weight of S, 2.05-2.20% by weight of Cr, 0.80-0.90% by weight of Mo, 0.70-0.80% by weight of Ni, 0.25-0.35% by weight of V and 0.60-0.70% by weight of W, and wherein the second material comprises a steel which is tough at low temperatures having the composition:

0.22-0.32% by weight of C, ≦0.15% by weight of Si, 0.15 to 0.40% by weight of Mn, ≦0.010% by weight of P, ≦0.007% by weight of S, 1.20-1.80% by weight of Cr, 0.25-0.45% by weight of Mo, 3.40-4.00% by weight of Ni, 0.05-0.15% by weight of V.

12. A process for producing a turbine shaft, comprising:

orienting a first material and a second material in an axial direction; and directly joining the first and second materials to one another by a structural weld, wherein 0.20-0.24% by weight of C, ≦0.20% by weight of Si, 0.60-0.80% by weight of Mn, ≦0.010% by weight of P, ≦0.007% by weight of S, 2.05-2.20% by weight of Cr, 0.80-0.90% by weight of Mo, 0.70-0.80% by weight of Ni, 0.25-0.35% by weight of V and 0.60-0.70% by weight of W is used for the first material, and 0.22-0.32% by weight of C, ≦0.15% by weight of Si, 0.15-0.40% by weight of Mn, ≦0.010% by weight of P, ≦0.007% by weight of S, 1.20-1.80% by weight of Cr, 0.25-0.45% by weight of Mo, 3.40-4.00% by weight of Ni, 0.05-0.15% by weight of V is used for the second material.

* * * * *